United States Patent [19]

Hirschmanner et al.

[11] Patent Number: 4,528,434

[45] Date of Patent: Jul. 9, 1985

[54] COILER-FURNACE UNIT

[75] Inventors: Franz Hirschmanner, Leonding; Ernst Rom, St. Veit, both of Austria

[73] Assignee: Voest-Alpine Aktiengesellschaft, Linz, Austria

[21] Appl. No.: 468,083

[22] Filed: Feb. 22, 1983

[30] Foreign Application Priority Data

Mar. 23, 1982 [AT] Austria ..... 1122/82

[51] Int. Cl.[3] ..... H05B 5/00

[52] U.S. Cl. ..... 219/10.49 A; 219/10.49 R; 219/10.61 A

[58] Field of Search ..... 219/10.49 A, 10.61 A, 219/10.67, 10.49 R, 10.61 R, 10.73, 469, 470, 160, 242; 29/117, 113

[56] References Cited

U.S. PATENT DOCUMENTS

| | | | |
|---|---|---|---|
| 457,561 | 8/1891 | Kennedy | 219/10.49 R |
| 1,516,970 | 11/1924 | Kiger | 219/242 |
| 1,554,800 | 9/1925 | Dodge, Jr. | 219/242 |
| 3,926,415 | 12/1975 | Konas et al. | 219/10.73 X |
| 4,237,359 | 12/1980 | Röth | 219/10.41 |
| 4,443,679 | 4/1984 | Balordi | 219/10.49 R |

FOREIGN PATENT DOCUMENTS

| | | | |
|---|---|---|---|
| 542276 | 1/1932 | Fed. Rep. of Germany . | |
| 818509 | 12/1951 | Fed. Rep. of Germany A | 219/10.49 |
| 937606 | 8/1948 | France . | |
| 1427524 | 12/1965 | France . | |

*Primary Examiner*—Roy N. Envall, Jr.
*Assistant Examiner*—M. M. Lateef
*Attorney, Agent, or Firm*—Kurt Kelman

[57] ABSTRACT

In a coiler-furnace unit comprising a coiler having a coiler mandrel arranged for carrying a strip wound on the mandrel, the improvement comprises a heating device arranged for selective movement between a first position wherein the heating device surrounds and heats the coiler mandrel, and a second position wherein the heating device is removed from the coiler mandrel. The heated coiler mandrel heats the strip wound thereon in the second position of the heating device.

4 Claims, 4 Drawing Figures

COILER-FURNACE UNIT

BACKGROUND OF THE INVENTION

1. Field of the Invention

This invention relates to a coiler-furnace unit comprising a coiler having a mandrel for carrying the strip which is to be heated.

2. Description of the Prior Art

For a compensation of heat losses suffered by a strip during hot rolling, it is usual to provide coiler-furnace units before and behind reversible hot-rolling mill stands. In such coiler-furnace units the strip to be rolled is heated between successive passes. The coiler-furnace unit usually comprises a heat-shielding hood and a coiler mandrel protruding into said the hood. The strip wound on the mandrel is heated by hot flue gases which promote the formation of undesirable scale. The scale is wound in between the convolutions of the coiled strip and is subsequently rolled into the strip so that the surface finish of the resulting hot-rolled strip may be highly adversely affected. Besides, the sulfur contained in the flue gases deteriorates the nickel-containing steel of which such coiler mandrels are usually made.

In order to avoid these disadvantages, it has been proposed in French Pat. No. 1,427,524 to heat the strip electrically by means of a resistance heater in which the strip is used as a heating resistor. For this purpose, electric current is conducted through the strip between the coiler and pinch rollers preceding the coiler. But because no heat insulation is provided in this arrangement, it has not been able to heat the strip to sufficiently high rolling temperatures with an economical expenditure of energy. Besides, scale may be formed by sparks produced where the current enters the strip. Finally, a considerable cropping loss is involved because the strip is heated between the coiler and the pinch rollers preceding the coiler so that the strip cannot be entirely wound on and unwound from the coiler.

SUMMARY OF THE INVENTION

It is an object of the invention to avoid these disadvantages and to provide a coiler-furnace unit in which the strip can be heated economically and with simple means without formation of scale and in which the coiler mandrel is substantially protected.

This object is accomplished according to the invention with a coiler mandrel which is designed as a heater for heating the strip and an electric heating device for heating the coiler mandrel. The heating device surrounds the coiler mandrel and is removable from it.

Because the coiler mandrel serves as a heater for heating the strip, the strip which has been coiled on the heated coiler mandrel is heated by heat conducted from the interior of the coiled strip so that no scale can be formed as a result of the heating, particularly because the heating device for heating the coiler mandrel is electrically powered. The use of the coiler mandrel for heating the strip has the additional advantage that can be minimized because the coiler mandrel has a relatively down times low heat capacity so that it can be coiled and heated quickly. The heating device surrounding the coiler mandrel can be designed for an economical heat transfer because the heat losses due to radiation and convection can be minimized. As the heating device merely surrounds the coiler mandrel, the latter may be heated when it is at a standstill or when it is being driven. No problems are involved in the power supply to the heating device because the latter need not move with the coiler mandrel. It will be understood that the heating device must be removed from the coiler mandrel when strip is wound thereon because the coiler mandrel must then be rendered accessible. As the heating device can be removed from the coiler mandrel immediately before the strip is coiled, the radiation of heat from the coiler mandrel before the coiling operation is limited.

Because the heating device surrounds the coiler mandrel during the interval of time between successive coiling-uncoiling operations of the coiler, the coiler mandrel is protected by the heating device so that the coiler-furnace unit can be desirably installed below the floor level as splash water and rolling mill scale cannot act on the coiler mandrel. Whereas the heating device could be moved transversely to the axis of the mandrel to its operative position in which it surrounds the coiler mandrel, this would require the use of a split heating device. A much simpler arrangement will be obtained if the heating device consists of a sleeve with an electric heater and axially slidable over the coiler mandrel. The use of an integral heating device results in a much simpler design and, because it is axially displaced relative to the coiler mandrel, facilitates the access to the coiler mandrel.

The electric heater of the heating device might consist of a resistance heater but in that case the heat generated by the heating device would have to be transferred to the coiler mandrel. Therefore, it will be more desirable to provide an electric heating device comprising an induction coil by which eddy currents heating the coiler mandrel are induced in the latter so that the coiler mandrel is inductively heated without a need for the transfer of heat from the heating device to the coiler mandrel.

In order to avoid any loss of radiant heat from the heating device, the latter may be provided near its outside peripheral surface with heat insulation.

BRIEF DESCRIPTION OF THE DRAWING

The subject matter of the invention is shown by way of example in the drawings, in which.

DESCRIPTION OF THE PREFERRED EMBODIMENTS

Figure 1:
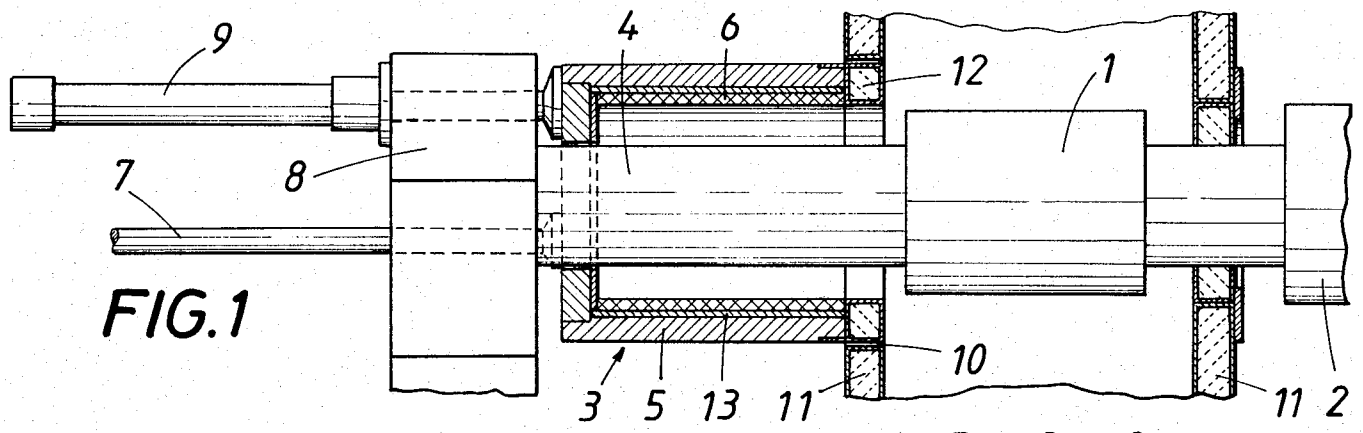
FIG. 1 is a diagrammatic sectional view showing a coiler-furnace unit according to the invention provided with a heating device which has been removed from the coiler mandrel.
Figure 2:
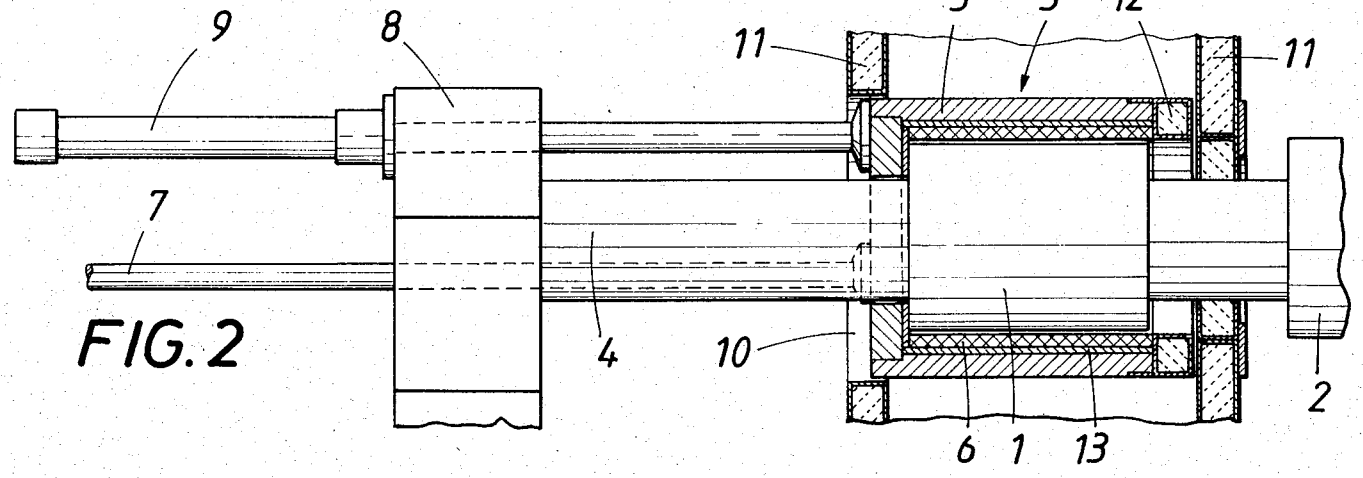
FIG. 2 shows the coiler-furnace unit shown in FIG. 1 with the heating device in operative position.

In accordance with FIGS. 1 and 2 the coiler mandrel 1 of the coiler 2 of a coiler-furnace unit is rotatably mounted at both ends. According to the invention, this conventional coiler-furnace unit comprises heating device 3 for heating the coiler mandrel 1. The heating device consists of a sleeve which is slidable onto the mandrel shaft 4 to coaxially surround the same and which carries an electric higher 6. Sleeve 5 is axially slidably mounted on the bearing support 8 for the mandrel shaft 4 by means of guide rods 7 and can be pushed over the coiler mandrel 1 by means of a fluid-operable cylinder 9 through a suitable opening 10 in the heat-shielding hood 11 which surrounds the coiler mandrel 1, as is shown in FIG. 2. The arrangement is such that the heat insulation 12 provided at the open end of the sleeve 5 adjoins the heat-shielding hood adjacent to the opening 10 when the sleeve is in its inoperative position shown in FIG. 1 and that said heat insulation adjoins the heat-shielding hood 11 at the wall that is opposite to the opening 10 when the sleeve is in its operative position shown in FIG. 2 whereas in that position the opening 10 is closed by the closed end of the sleeve 5. As a result, a loss of radiant heat is effectively prevented in both operative positions. It will be understood that the sleeve 5 may be provided with peripheral heat insulation 13, which is preferably disposed on the inside surface of the shell of the sleeve 5 so that this shell will not be unnecessarily heated.

If the electric heater 6 comprises an induction coil, the coiler mandrel 1 can be directly induction-heated by the heating device 3 when the latter is in its operative position shown in FIG. 2 and the heat thus generated in the coiler mandrel can be transferred to the strip being coiled onto the coiler mandrel when the heating device is in the position shown in FIG. 1. The use of the coiler mandrel 1 as a heater for the strip to be heated ensures that no scale can be formed in spite of the high temperature rise.

Figure 3:
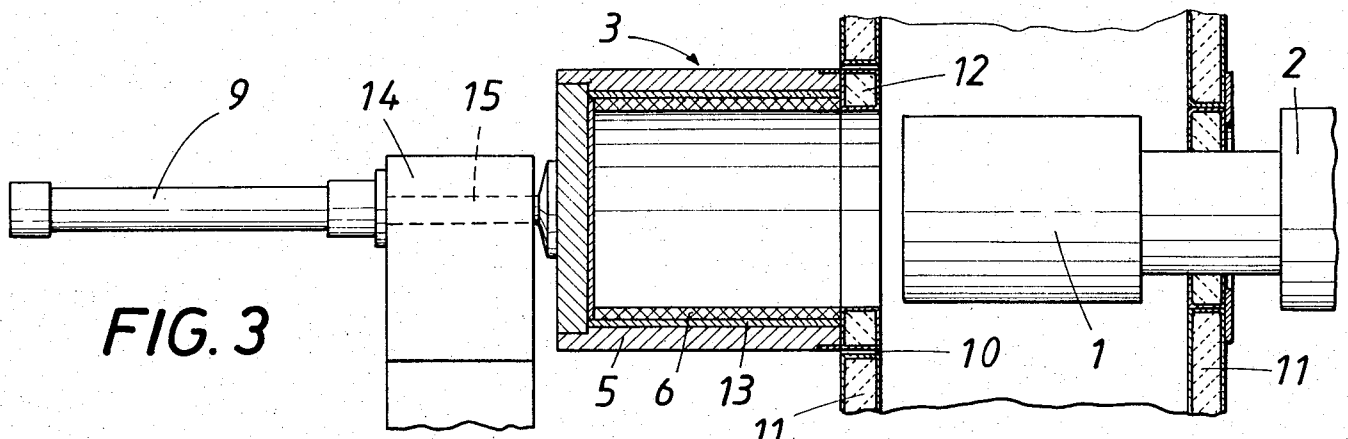
FIG. 3 is a view similar to FIG. 1 and shows a modified coiler-furnace unit according to the invention and FIG. 4 shows the coiler-furnace unit of FIG. 3 with its heating device in operative position.
Figure 4:
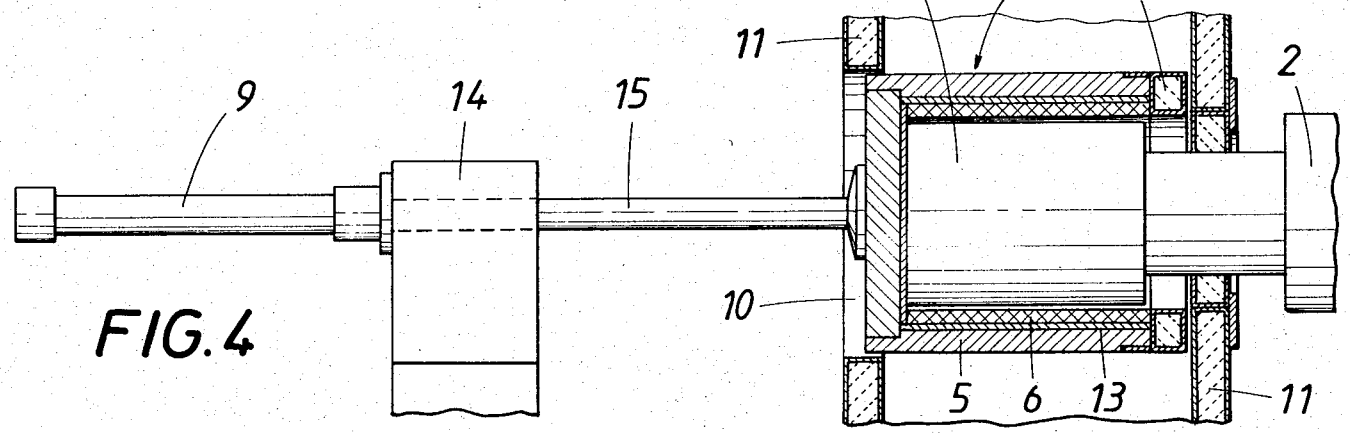

The coiler-furnace unit shown in FIGS. 3 and 4 differs from the coiler-furnace unit shown in FIGS. 1 and 2 only in that the coiler mandrel 1 of the coiler 2 is supported only at one end. For this reason, the heating device 3 is supported by a separate bearing 14 and its movement is controlled only by the coaxial piston rod 15 of the fluid-operable cylinder 9. The arrangement is similar in other respects, particularly as regards the economical use of energy and the simple design. It is emphasized in this connection that the sleeve 5 effectively protects the coiler mandrel 1 from mechanical influence, for instance, by splash water or scale, so that the unit can be installed below the floor level in order to save space. Whereas the heating device 3 can be pushed over the coiler mandrel 1, the latter as well as the heating device 3 remain freely accessible for servicing. Another advantage afforded by the use of the heating device according to the invention for heating the coiler mandrel 1 resides in that power can be supplied to the heating device by structurally simple means because the power can be supplied to a slidably mounted, non-rotatable element, whether or not the coiler mandrel 1 is driven as it is heated.

What is claimed is:

1. In a coiler-furnace unit comprising a coiler having a coiler mandrel arranged for carrying a strip wound on the mandrel, the improvement comprising (a) a heating device arranged for selective movement between a first position wherein the heating device surrounds and heats the coiler mandrel, and a second position wherein the heating device is removed from the coiler mandrel, and (b) the heated coiler mandrel being adapted to heat the strip wound thereon in the second position of the heating device.

2. The improvement in a coiler-furnace unit set forth in claim 1, wherein the heating device comprises a sleeve and an electric heater carried by the sleeve, and the sleeve is arranged to be axially slidable with respect to the coiler mandrel between the first and second positions.

3. The improvement in a coiler-furnace unit set forth in claim 2, wherein the electric heater comprises an induction coil.

4. The improvement in a coiler-furnace unit set forth in claim 1, wherein the heating device comprises a peripheral shell carrying heat insulation.

* * * * *